United States Patent [19]

Törneman et al.

[11] Patent Number: 5,045,002

[45] Date of Patent: Sep. 3, 1991

[54] JET PROPULSION ASSEMBLY FOR SHIPS

[75] Inventors: Gerard Törneman, Gimo; Nils E. Lundberg, Österbybruk, both of Sweden

[73] Assignee: MJP Marine Jet Power AB, Osthammar, Sweden

[21] Appl. No.: 435,416

[22] PCT Filed: May 20, 1988

[86] PCT No.: PCT/SE88/00269

§ 371 Date: Nov. 16, 1989

§ 102(e) Date: Nov. 16, 1989

[87] PCT Pub. No.: WO88/09287

PCT Pub. Date: Dec. 1, 1988

[30] Foreign Application Priority Data

May 21, 1987 [SE] Sweden ..... 8702121

[51] Int. Cl.[5] ..... B63H 11/00

[52] U.S. Cl. ..... 440/38; 440/83

[58] Field of Search ..... 440/38, 47, 83; 60/221, 60/222; 416/131, 134 R, 204 R, 290, 244 B, 247 B, 135, 174; 464/51, 88, 92; 415/140-142

[56] References Cited

U.S. PATENT DOCUMENTS 4,391,594 7/1983 Hannibal et al. ..... 464/92

4,474,561 10/1984 Haglund ..... 60/221 X

FOREIGN PATENT DOCUMENTS 1281286 12/1962 France .

424845 8/1982 Sweden .

1144938 3/1985 U.S.S.R. ..... 440/38

1450903 11/1972 United Kingdom .

*Primary Examiner*—Ed Swinehart

*Attorney, Agent, or Firm*—Witherspoon & Hargest

[57] ABSTRACT

The present invention relates briefly to a jet propulsion assembly for ships, the assembly including a propeller pump of an axial or a semiaxial type. The propeller pump has a pump housing (6), the inlet of which is connected to a water inlet channel and the outlet of which is connected to an outlet device. In the water flow channel through the pump housing a pump wheel (11) is rotably journalled in a stationary casing (8). A drive shaft (12) of the pump wheel (11) extends from a drive unit through the water inlet channel to the pump wheel (11). The pump wheel (11) and the drive shaft (12) are connected by a flexible coupling (13) which is essentially torsional resistant but permits angular deviations between the drive shaft (12) and the rotational shaft of the pump wheel (11).

2 Claims, 2 Drawing Sheets

JET PROPULSION ASSEMBLY FOR SHIPS

BACKGROUND OF THE INVENTION

The present invention relates to propulsion devices for ships and in particular to a water jet propulsion assembly comprising a propeller pump enclosed in a pump housing.

The pump wheel of the jet propulsion assembly of the kind concerned by this invention is normally mounted to the drive shaft which extends through the inlet canal. The drive shaft end is journalled in the pump housing by means of water-lubricated bushings, oil-lubricated spherical bearings or similar. See for instance the Swedish patent No. 8008288-6.

With a pump wheel mounted in such a way directly to the drive shaft, there is merely one problem present, i.e. the dimensioning of the drive shaft. Since the drive shaft disturbs the affluence of the water to the pump, the result is an uneven load on the pump wheel vanes. Such an uneven load induces a bending moment, which is transmitted to the pump shaft, and which has to be taken into consideration when dimensioning the shaft. It is appreciated that due to the bending moment the shaft be given a relatively generous diameter, which in turn increases the disturbance of the water flow to the pump, and thus renders increased losses. Another close problem consists in that the drive shaft deviates from the theoretically correct position, which leads to either increased wear on the bearing in the pump housing or, if the bearing is fitted to receive angular deviations, a large risk that the pump wheel vanes will bump into the inner walls of the pump housing, since the pump wheel is directly mounted to the drive shaft. For the best power economy possible, the pump wheel vanes should terminate as closely to the pump housing inner walls as possible.

The purpose of the present invention is to eliminate the above problems. The purpose is attained by the provision of a jet propulsion assembly of the above mentioned kind, wherein the drive shaft is fitted not to be affected by a bending moment or by other forces, for example pressure forces, from the pump wheel but only to transmit turning moments from the drive machinery, at the same time as the angular deflections of the drive shaft do not affect the precise bearing of the pump wheel. The actual invention object as well as that which is characteristic thereof are evident from the accompanied patent claims.

The invention will now be described in more detail, in conjunction with the attached drawings, which in the exemplary form of the invention show an embodiment of a jet propulsion assembly according thereto.

BRIEF DESCRIPTION OF THE INVENTION

FIG. 1 illustrates a longitudinal view partially in cross section of a jet propulsion assembly according to the invention, and FIG. 2 illustrates an axial section through the pump unit of a jet propulsion assembly according to the invention.

DETAILED DESCRIPTION OF THE PREFERRED EMBODIMENT

Figure 1:
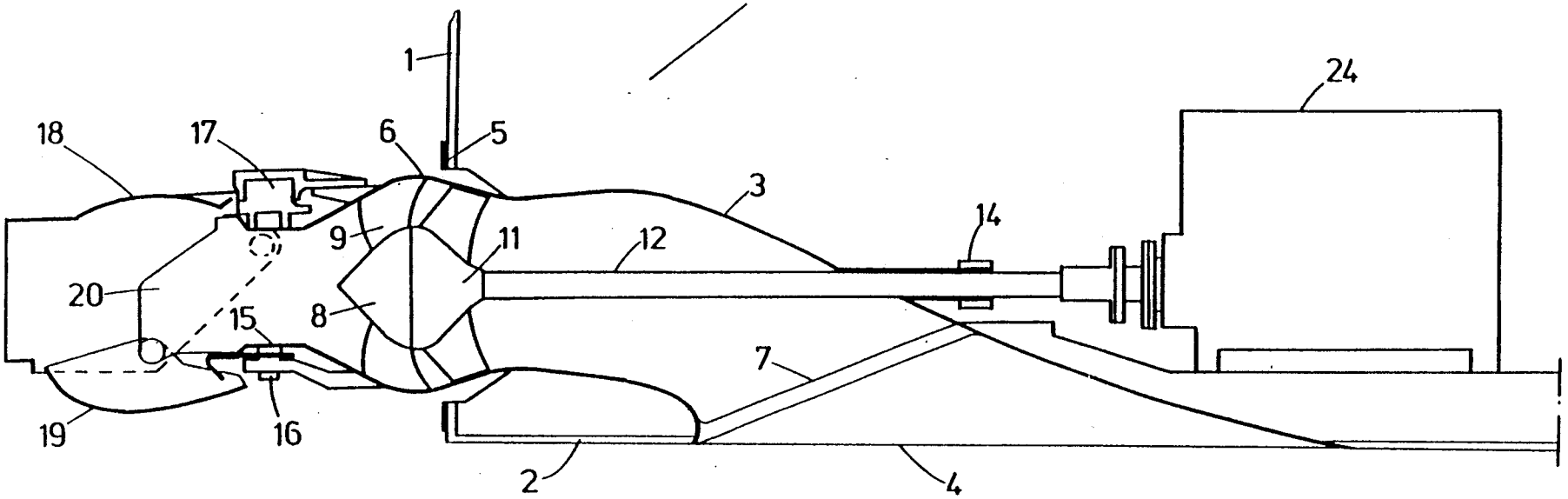
Figure 2:
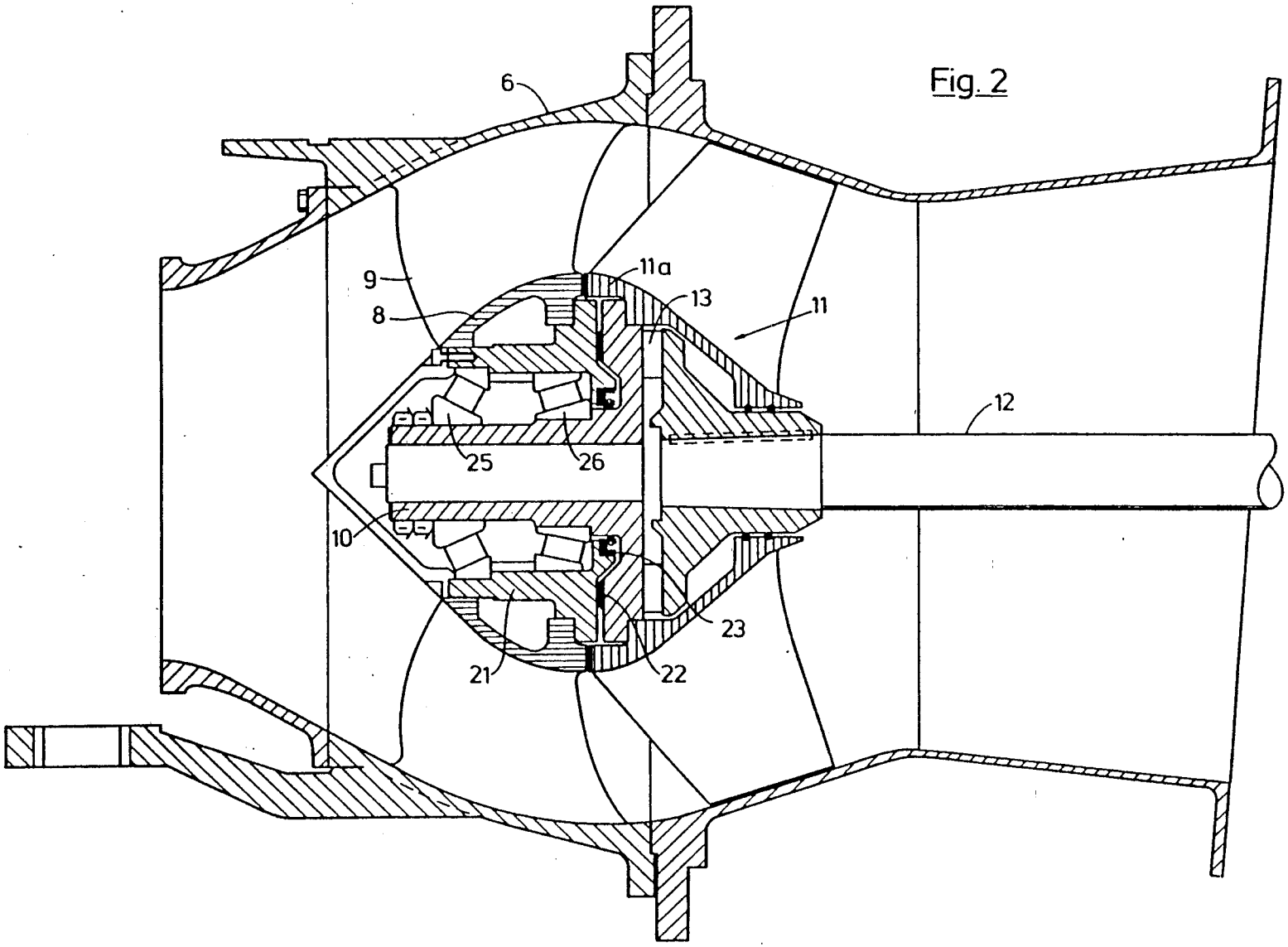

Referring to FIG. 1 a jet propulsion assembly S is mounted at the stern of a ship, of which only the stern 1 and the ship bottom 2 are schematically implied. The jet propulsion assembly S includes an inlet canal 3, which extends from a water inlet 4 in the ship bottom to a mounting flange 5 for the pump housing 6 of the assembly. The inlet 4 is provided with a grid 7, which prevents objects from being sucked into the actual jet propulsion assembly S.

In the illustrated embodiment the pump is comprised of a propeller, which is journalled for rotation in a hub casing 8, which is provided downstream centrally through the pump housing 6. This hub casing is supported by articulated vanes 9, which extend between the inside of the pump housing 6 wall and the outside of the hub casing 8. In the hub casing 8, a hub 10 equipped with a flange is journalled for rotation, and the pump wheel 11 is secured in place on the hub 10 flange. A drive shaft 12 extends from an engine 24 through the inlet canal 3 and projects into the pump housing 6. A flexible coupling 13 is provided between the flanged hub 11 and the drive shaft 12. This coupling is such that neither pressure forces nor bending moments can be transmitted from the pump wheel 11 to the drive shaft, which allows dimensioning of drive shaft solely for transmission of turning moments from the drive machinery 24. A flexible sealing 14 seals the drive shaft 12 against the flow passage in the inlet canal and this flexible sealing 14 allows of a less precise alignment of the drive shaft and coupling to the drive machinery 24.

The pump housing 6 has its outlet leading to an outlet pipe 15, on which a laterally pivotal steering means 20 is mounted. The steering means 20 is journalled in vertical spindles 16 land 17 and is laterally pivoted by means of not further shown hydraulic engines. The steering of the ship takes place when the water jet from the pump is diverted to either side of the steering means 20 inner walls.

To reverse the force direction of the assembly for the retardation or backing of the ship, two flaps 18, 19 are adapted to be swung into the water jet way, so that the jet way is gradually diverted from full speed ahead, the jet being directed straight rearwards, to full speed rearwards, the jet being directed obliquely downwards/forwards. Between the two extreme positions, intermediate positions can, if so desired, be set. The jet will then be partially diverted forwards and partially be projecting rearwards. The upper flap 18 also has the function to act as a splash shield during the above diversion. The upper flap 18 will thereby overlap the rear ends and sides of the lower flap 19. Through the described reversing device, steering can also be obtained during a ship's backing up operation by diverting the jet in the intended direction which can be done by said steering means 20.

In the shown embodiment the hub 10 is journalled in the hub casing 8 by means of oil- or grease-lubricated roller bearings 25, 26, which provide a very precise bearing of both the hub 10 and the pump wheel 11 mounted to the hub flange. Ball bearings and slide bearings are in certain cases also possible to use as well as different combinations of bearing types. Possible errors of the alignment of the drive shaft 12 are carried by the torsion resistant but flexible coupling 13, which is provided between the hub 10 and shaft 12. This coupling 13 makes possible a very precise positioning of the pump wheel 11 vanes relative to the pump housing 6 inner wall, without the vanes being affected by a possible angular deflection of the drive shaft.

The hub 10 is mounted so that its flange rotates at a relatively small distance from the flange of the bearing holder 21. On the outside of the hub 10 towards the bearing holder 21, there is mounted a suitable amount of radial vanes 22, the function of which is to reduce the pressure against the sealing 23 and that you counteract an accretion of debris and similar in the gap between the bearing holder 21 and hub 10. To further decrease the risk for accretion of debris, the wheel hub 11*a* of the pump wheel rotates at a very little distance from the hub casing 8 and is, along its outer circumference, equipped with a number of milled-out radial grooves adapted to cut apart possible cords and algae, which could accompany the flowing water and stick to the articulated vanes 9.

The pump wheel 11 being steadily and separately journalled for rotation and flexibly coupled to the drive shaft 12, there will be no significant bending moment nor other negative forces between the shaft and pump wheel. Therefore, the drive shaft 12 can be made relatively small, since it needs to be dimensioned only for the transmission of rotary forces. Thereby, less flow disturbances are received, which would negatively affect the pump wheel. Thus, the initially mentioned purpose has been attained by the present invention.

What is claimed is:

1. A jet propulsion assembly for ships, comprising:

a drive unit;

a drive shaft attached to said drive unit for rotation by said drive unit;

a pump housing having an inlet side connected to a water inlet canal, an opposite outlet side, and a water passageway extending therebetween; and a propeller pump housed within said pump housing, said propeller pump including:

a hub casing fixedly attached within said pump housing and positioned within said water passageway;

a pump wheel having a bowl-shaped portion and being rotatably journalled within said hub casing; and means coupling said pump wheel to said drive shaft for causing rotation of said pump wheel by said drive shaft, providing torsional resistance and permitting angular deflection of said drive shaft, said means including a flexible coupling disposed within said bowl-shaped portion.

2. The jet propulsion assembly of claim 1 wherein said propeller pump further includes a hub journalled for rotation within said hub casing by roller bearings, said hub being secured to said pump wheel and to said flexible coupling.

* * * * *